US008096535B2

(12) United States Patent
Oliver

(10) Patent No.: US 8,096,535 B2
(45) Date of Patent: Jan. 17, 2012

(54) APPARATUS FOR HOLDING MARTIAL ARTS BOARDS

(76) Inventor: Darryl Oliver, Colorado Springs, CO (US)

( * ) Notice: Subject to any disclaimer, the term of this patent is extended or adjusted under 35 U.S.C. 154(b) by 622 days.

(21) Appl. No.: 12/210,168

(22) Filed: Sep. 12, 2008

(65) Prior Publication Data

US 2009/0082178 A1 Mar. 26, 2009

Related U.S. Application Data

(60) Provisional application No. 60/975,438, filed on Sep. 26, 2007.

(51) Int. Cl.
*B25B 1/00* (2006.01)

(52) U.S. Cl. ..... 269/3; 269/6; 269/41

(58) Field of Classification Search ..... 369/41, 369/3, 6, 95, 43, 45; 29/270, 278
See application file for complete search history.

(56) References Cited

U.S. PATENT DOCUMENTS

| | | | | |
|---|---|---|---|---|
| 3,397,414 | A * | 8/1968 | Webb | 441/56 |
| 5,673,903 | A * | 10/1997 | Lewis | 269/41 |
| 6,247,690 | B1 * | 6/2001 | Wolf | 269/277 |
| 6,443,441 | B1 * | 9/2002 | Buitenhuis | 269/41 |
| 6,994,322 | B1 * | 2/2006 | Wittman | 254/131 |
| 7,128,313 | B1 * | 10/2006 | Pliley | 269/95 |
| 7,708,261 | B2 * | 5/2010 | Cullen | 269/41 |

* cited by examiner

*Primary Examiner* — Lee D Wilson

(57) ABSTRACT

An apparatus for holding martial arts boards includes a first grip including a curved section for grasping the first grip in varying positions and a slot for holding a first end of the martial arts board. The slot is perpendicular to and distal from the curved section where when the martial arts board is inserted in the slot the martial arts board is perpendicular to the curved section and in front of a user's hand grasping the curved section such that the user's hand is protected from striking blows to the martial arts board. The apparatus accommodates martial arts boards of varying thickness and grips the martial arts board in the slot.

14 Claims, 1 Drawing Sheet

APPARATUS FOR HOLDING MARTIAL ARTS BOARDS

CROSS-REFERENCE TO RELATED APPLICATIONS

The present Utility patent application claims priority benefit of the U.S. provisional application for patent Ser. No. 60/975,438 filed on Sep. 26, 2007 under 35 U.S.C. 119(e). The contents of this related provisional application are incorporated herein by reference for all purposes.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to martial arts. More particularly, the invention relates to a martial arts board holder.

BACKGROUND OF THE INVENTION

Breaking boards is a common practice among martial artists worldwide and is customary for training and testing and is also done for recreation. Breaking boards, like many martial arts activities, can cause injury if not performed carefully and accurately. A common injury when breaking boards is injuring the fingers of the person or persons holding the board(s). Generally one or two people hold a board for the practitioner who is striking the board with his hand or foot using various techniques. If the person striking the board does not hit the board accurately, he may strike or kick the board holder's fingers causing injury.

There have been remedies for this by creating devices that eliminate a person holding the boards in their hands by installing a mechanism to hold the boards against a wall, against bodies or against heavy bags; however these devices can be very large, heavy, expensive, and encumbering. These devices cannot be held in one's hands but instead are held against a person's body, held against a big bag, sit on the floor, or are mounted to a wall. Furthermore, these contraptions primarily hold wood boards, and do not accommodate rebreakable boards, which are growing in number and popularity.

In view of the foregoing, there is a need for improved techniques for holding a board or boards for striking and breaking in martial arts that protects the person holding the board, is convenient to use and accommodates wood boards and rebreakable boards.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A shows the grip without rubber discs, and FIG. 1B shows the grip with rubber discs.

Figure 1A:
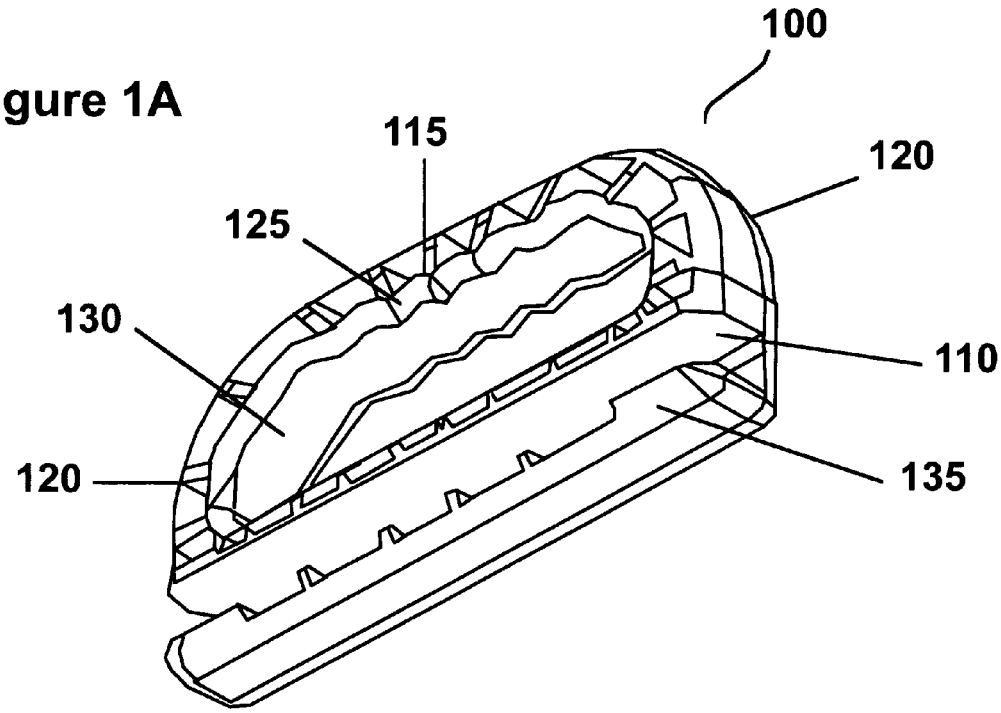
FIGS. 1A and 1B illustrate perspective views of an exemplary grip for a martial arts board holder, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, an apparatus for holding martial arts boards is presented.

In one embodiment an apparatus for holding martial arts boards includes a first grip including a curved section for grasping the first grip in varying positions and a slot for holding a first end of the martial arts board. The slot is perpendicular to and distal from the curved section where when the martial arts board is inserted in the slot the martial arts board is perpendicular to the curved section and in front of a user's hand grasping the curved section such that the user's hand is protected from striking blows to the martial arts board. Other embodiments further include means for accommodating martial arts boards of varying thickness and gripping means for holding the martial arts board in the slot. Various other embodiments include means for improving a grasp of the user's hand. In yet another embodiment a curved lip meeting the slot mitigates injuries from striking the martial arts board incorrectly. Another embodiment further includes a second grip including a curved section for grasping the second grip in varying positions and a slot for holding a second end of the martial arts board. The slot is perpendicular to and distal from the curved section where when the martial arts board is inserted in the slot the martial arts board is perpendicular to the curved section and in front of a user's hand grasping the curved section such that the user's hand is protected from striking blows to the martial arts board.

In another embodiment an apparatus for holding martial arts boards includes two grips including a curved sections for grasping the grips in varying positions. The curved sections include means for improving grasps of a user's hands. Slots hold ends of the martial arts board. The slots are perpendicular to and distal from the curved sections where when the martial arts board is inserted in the slots the martial arts board is perpendicular to the curved sections and in front of the user's hands grasping the curved sections such that the user's hands are protected from striking blows to the martial arts board. Curved lips meet the slots where the curved lips mitigate injuries from striking the martial arts board incorrectly. Means for accommodating martial arts boards of varying thickness are provided.

In another embodiment an apparatus for holding martial arts boards includes first gripping means for holding the martial arts board. Other embodiments further include means for accommodating martial arts boards of varying thickness and second gripping means for holding the martial arts board.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

A preferred embodiment of the present invention provides a martial arts board holder that enables martial arts practitioners to hold both wood and rebreakable boards for persons striking the boards in various positions and locations while protecting the fingers of the person holding the board from injury. Preferred embodiments are not heavy and do not have to be mounted against something such as, but not limited to, a wall, a body, a large bag, etc. to be used.

Martial arts board holders according to preferred embodiments of the present invention satisfy the needs of board breaking practitioners in that they protect the fingers of the person holding the boards and they give confidence to the striker because they generally eliminate fear and apprehension of kicking the fingers of the person holding the board Preferred embodiments are versatile because they are not mounted to a wall or a bag, can be used in any location, and can hold various breaking boards in many positions. Preferred embodiments can accommodate both wood boards and the various rebreakable boards on the market.

Figure 1B:
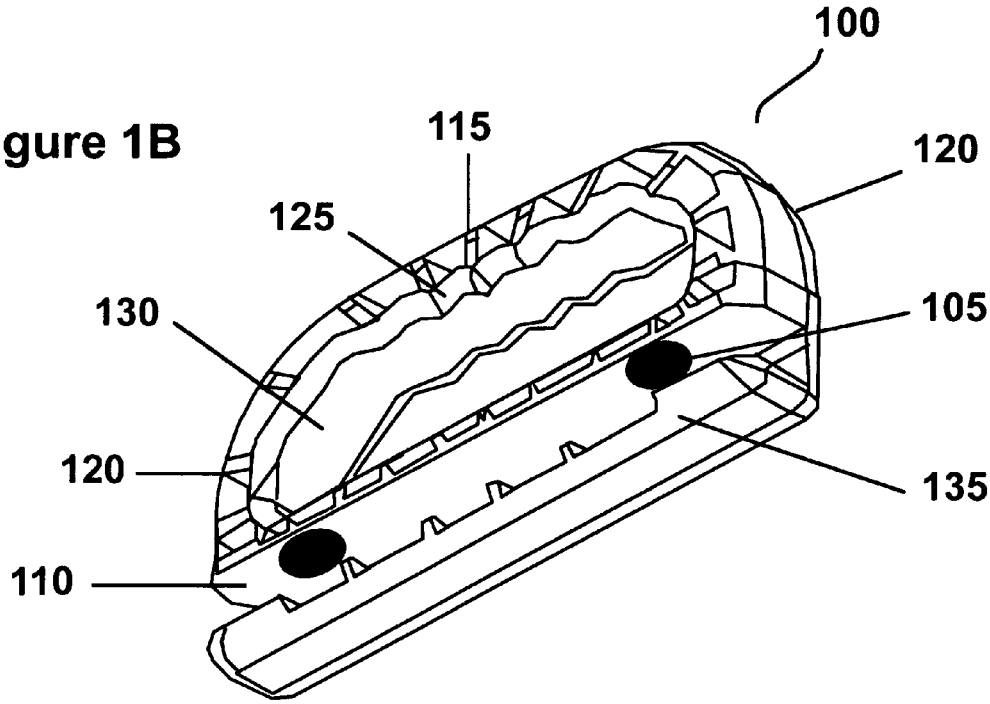

FIGS. 1A and 1B illustrate perspective views of an exemplary grip 100 for a martial arts board holder, in accordance with an embodiment of the present invention. FIG. 1A shows grip 100 without rubber discs 105, and FIG. 1B shows grip 100 with rubber discs 105. In the present embodiment, the martial arts board holder is designed to hold both 1" and ½" wood boards as well as various rebreakable boards available in the marketplace. However, alternate embodiments may be designed to hold boards of different sizes or multiple boards. The martial arts board holder comprises two identical grips 100 with channels 110 into which the breaking boards slide. In the present embodiment, grip 100 comprises an 80 mm section that has a straight edge 115 and curved sections 120 on the outer sections so the person holding grip 100 can adjust positions of the board depending on the type of striking technique being used. For example, without limitation, a person can position the board at head level or higher and at an angle for an ax kick or the person may position the board low with no angle for a front kick. Alternate embodiments may be longer than or shorter than 80 mm depending on factors such as, but not limited to, the size of the board being broken and the type of striking technique being used. In the present embodiment, grip 100 also comprises finger grooves 125 as well as a textured surface 130 to improve the grasp of the person holding grip 100. Those skilled in the art, in light of the present teachings, will readily recognize that a multiplicity of suitable means may be used to create textured surface 130 such as, but not limited to, stamping or carving a texture into the material of grip 100 or attaching a textured pad made of a high friction material such as, but not limited to rubber to grip 100. This helps support the board holder in the person's hands and helps to generally eliminate slipping. However, alternate embodiments may be implemented without finger grooves or a textured surface In the present embodiment, grip 100 is designed to accommodate a single person holding the board holder or two persons holding the board holder. There are rebreakable boards that are difficult to break and require two people holding the board to increase support of the board being broken. The outer area of channel 110 that faces the striker has a curved lip 135 that converges into the board as opposed to a sharp ridge that could cause more injury to the striker if hit incorrectly. In an alternate embodiment this curved lip may also include padding to further protect the striker from injury. In the present embodiment, grip 100 is made of 70% nylon and 30% glass fiber and each grip 100 weighs approximately 13.5 ounces. The material and the design of grip 100 in the present embodiment is durable and can accommodate the toughest boards on the market without breaking, for example, without limitation, the UMAB black board, which is equivalent to 2.25 wood pine boards. Those skilled in the art, in light of the present teachings, will readily recognize that grips for martial arts board holders may be made of a multiplicity of suitable materials in alternate embodiments such as, but not limited to, various plastics, rubber, metal, etc.

In typical use of the present embodiment, a user affixes two rubber discs 105 to the inside of channel 110 of each grip 100 to accommodate either wood boards or rebreakable boards. Because the widths of the wood boards and rebreakable boards vary, the martial arts board holder comprises rubber discs 105 of various thicknesses to accommodate various thicknesses of boards. For example, without limitation, the board holder may come with both 4 mm and 5 mm rubber discs where the user would affix the 4 mm rubber discs to the grips when breaking wood boards and the 5 mm rubber discs when breaking rebreakable boards. In some applications, grips 100 may require two single rubber discs 105 per channel 110 or multiple rubber discs 105 stacked upon one another for thinner breaking boards. In another alternate application four rubber discs 105 may be applied to grips 100 with two rubber discs 105 on the top of channel 110 and two more rubber discs 105 on the bottom of channel 110. Rubber discs 105 also function as gripping means to hold the breaking board in channel 110. Generally, a breaking board is inserted into channels 110 of a set of two grips 100 after rubber discs 105 have been applied to properly secure the board being broken within grips 100. In an alternate use, a breaking board can be held by one grip 100 for exercises such as, but not limited to, hand and foot speed techniques performed by some martial artists.

In the present embodiment, the martial arts board holder is designed to protect the fingers of the person holding the board from injury by the striker's foot or hand when breaking boards. The martial arts board holder puts the hands and fingers of the person holding the board being struck behind the board by placing the breaking board in channels 110 that are positioned in the front section of grips 100 that are held by the person holding the board. This benefits both the person holding the board and the striker. The person holding the board no longer fears getting his fingers injured by the striker and the striker no longer fears injuring the fingers of the person holding the board thereby giving the striker more confidence in training. The martial arts board holder does not have to be mounted against a wall or in a contraption but can be held by a practitioner anywhere and in various positions while protecting his fingers from injury. Martial Artists around the world will have more confidence in and have fewer reservations about holding breaking boards for expert and novice board breaking practitioners using the present embodiment because they no longer have to fear injury to fingers.

Having fully described at least one embodiment of the present invention, other equivalent or alternative methods of providing martial arts board holders according to the present invention will be apparent to those skilled in the art. The invention has been described above by way of illustration, and the specific embodiments disclosed are not intended to limit the invention to the particular forms disclosed. For example, the particular implementation of the channel may vary depending upon the particular type of board used. The channels described in the foregoing were directed to implementations for holding ¾1" and ½" wood boards and various rebreakable boards; however, similar techniques are to make the channels narrower or wider to accommodate thinner or thicker boards or multiple boards. Implementations of the present invention that have channels of different sizes are contemplated as within the scope of the present invention. The invention is thus to cover all modifications, equivalents, and alternatives falling within the spirit and scope of the following claims.

What is claimed is:

1. An apparatus for holding martial arts boards, the apparatus comprising:

a first grip comprising a curved section for grasping said first grip in varying positions, said curved section comprising two curved portions and a straight portion forming a c-shape having an opening configured for insertion of a portion of a user's hand to grasp said curved section said first grip further comprising a slot for holding a first end of the martial arts board, said slot being perpendicular to a plane containing said c-shape and being distal from and parallel to said straight portion of said curved section where, when the martial arts board is inserted in said slot, the martial arts board is perpendicular to said curved section and in front of the user's hand grasping said curved section, and the user's hand is protected from striking blows to a face of the martial arts board distal to the user.

2. The apparatus as recited in claim 1, further comprising means for accommodating martial arts boards of varying thickness.

3. The apparatus as recited in claim 2, wherein said accommodating means functions as gripping means for holding the martial arts board in said slot.

4. The apparatus as recited in claim 3, wherein said curved section of said first grip further comprises finger grooves for improving a grasp of said user's hand.

5. The apparatus as recited in claim 3, wherein said curved section of said first grip further comprises a textured surface for improving a grasp of said user's hand.

6. The apparatus as recited in claim 3, wherein said first grip further comprises a curved lip meeting said slot where said curved lip mitigates injuries from striking the martial arts board incorrectly.

7. The apparatus as recited in claim 3, further comprising a second grip comprising a curved section for grasping said second grip in varying positions, said curved section comprising two curved portions and a straight portion forming a c-shape having an opening configured for insertion of a portion of a user's hand to grasp said curved section, said second grip further comprising a slot for holding a second end of the martial arts board, said slot being perpendicular to a plane containing said c-shape and being distal from and parallel to said straight portion of said curved section where, when the martial arts board is inserted in said slot, the martial arts board is perpendicular to said curved section and in front of the user's hand grasping said curved section and the user's hand is protected from striking blows to a face of the martial arts board distal to the user.

8. The apparatus as recited in claim 7, wherein said curved section of said second grip further comprises finger grooves for improving a grasp of said user's hand.

9. The apparatus as recited in claim 7, wherein said curved section of said second grip further comprises a textured surface for improving a grasp of said user's hand.

10. The apparatus as recited in claim 7, wherein said second grip further comprises a curved lip meeting said slot where said curved lip mitigates injuries from striking the martial arts board incorrectly.

11. An apparatus for holding martial arts boards, the apparatus comprising:

two grips comprising a curved sections for grasping said grips in varying positions, said curved sections comprising two curved portions and a straight portion forming a c-shape having an opening configured for insertion of portions of a user's hands to grasp said curved sections, said curved sections further comprising means for improving grasps of the user's hands, said grips further comprising slots for holding ends of the martial arts board, said slots being perpendicular to planes containing said c-shapes and being distal from and parallel to said straight portions of said curved sections where, when the martial arts board is inserted in said slots, the martial arts board is perpendicular to said curved sections and in front of the user's hands grasping said curved sections such that, and the user's hands are protected from striking blows to the martial arts board, said grips further comprising curved lips meeting said slots where said curved lips mitigate injuries from striking the martial arts board incorrectly; and means for accommodating martial arts boards of varying thickness.

12. An apparatus for holding martial arts boards, the apparatus comprising:

first gripping means for holding the martial arts board, said first gripping means comprising means for grasping said first gripping means by insertion of a user's hand, said first gripping means further comprising means for retaining a first end of the martial arts board in front of the user's hand grasping the grasping means and protecting the user's hand form striking blows to a face of the martial arts board distal to the user.

13. The apparatus as recited in claim 12, further comprising means for accommodating martial arts boards of varying thickness.

14. The apparatus as recited in claim 13, further comprising second gripping means for holding the martial arts board, said second gripping means comprising means for grasping said second gripping means by insertion of a user's hand, said second gripping means further comprising means for retaining a second end of the martial arts board in front of the user's hand grasping the grasping means and protecting the user's hand form striking blows to a face of the martial arts board distal to the user.

* * * * *